United States Patent [19]

Hansen et al.

[11] 4,375,627

[45] Mar. 1, 1983

[54] TRANSFORMER TANK PANEL NEUTRAL CONNECTION WITH REVERSE CURRENT SHIELDING CONDUCTORS

[75] Inventors: Irvin L. Hansen; Randall W. Haack, both of Muncie, Ind.

[73] Assignee: Westinghouse Electric Corp., Pittsburgh, Pa.

[21] Appl. No.: 277,589

[22] Filed: Jun. 26, 1981

[51] Int. Cl.[3] ..... H01F 33/00; H01F 15/04

[52] U.S. Cl. ..... 336/5; 336/84 C; 336/90; 174/35 CE

[58] Field of Search ..... 336/5, 10, 12, 84 C, 336/90, 105; 174/35 CE

[56] References Cited

U.S. PATENT DOCUMENTS

| | | | |
|---|---|---|---|
| 2,220,015 | 10/1940 | Johnson . | |
| 2,853,636 | 9/1958 | Plöen . | |
| 2,857,530 | 10/1958 | Plöen . | |
| 3,327,268 | 6/1967 | Rabus | 336/84 C |
| 4,095,073 | 6/1978 | Frank | 200/293 |
| 4,174,509 | 11/1979 | Bach et al. | 336/12 |
| 4,296,395 | 10/1981 | Moritz | 336/60 |

FOREIGN PATENT DOCUMENTS

| | | | |
|---|---|---|---|
| 1540113 | 11/1969 | Fed. Rep. of Germany | 174/35 CE |

*Primary Examiner*—A. T. Grimley
*Assistant Examiner*—Susan A. Steward
*Attorney, Agent, or Firm*—L. P. Johns

[57] ABSTRACT

An electric transformer characterized by a transformer tank having an opening with a conducting closure panel in the opening and electrically insulated from the tank, a plurality of first and second conductors of opposite polarities leading from the transformer coil-core assembly with the conductors of opposite polarity comprising forward and return paths. A conducting tubular structure mounted on and extending inwardly from the inside surface of the panel and the return path conductors being connected to the corresponding tubular structures while the forward path conductors extend through the tubular structure and the panel to an external source.

4 Claims, 5 Drawing Figures

TRANSFORMER TANK PANEL NEUTRAL CONNECTION WITH REVERSE CURRENT SHIELDING CONDUCTORS

BACKGROUND OF THE INVENTION

1. Field of the Invention

This invention relates to high current furnace transformers and, more particularly, it pertains to a transformer tank panel neutral connection.

2. Description of the Prior Art

In high current furnace transformer applications, the magnetic eddy heating, the leakage reactance, and magnetic forces are typically controlled by alternating positive and negative current conductors. The alternating positive and negative scheme requires an external three-phase closure which is large, lossy, expensive, and subject to flashovers due to contamination. When the furnace transformer three phase connection is made internally, very large net currents must be brought through the tank. Consequently, a very high eddy loss and excessive temperatures can result both from high currents passing through and parallel to transformer tank panels.

SUMMARY OF THE INVENTION

In accordance with this invention it has been found that an electric transformer may be provided which comprises a transformer structure having a coil-core assembly, a tank casing enclosing the assembly and having an opening therein, a conducting panel for closing the opening, dielectric means between the panel and the casing for holding the panel in place, the panel having aperture means, a conductive tubular structure mounted on and extending inwardly from the inside surface of the panel and surrounding the aperture means, conductor means extending from the transformer winding through the tubular structure and aperture and including first and second conductors of opposite polarities, the first conductor being connected to the tubular structure, the second conductor extending through the tubular structure and the aperture, whereby a current passing within the panel reduces eddy current loss and heating of the panel associated with current passing through the panel.

The invention also includes the coil-core assembly of a three phase transformer of which the conductor means comprises three phase winding leads of forward and return paths with the return path leads being connected to their corresponding tubular structures and the forward paths extending through the tubular structure and aperture.

The advantage of the device of this invention is that it provides a tank panel shorting method for reducing eddy current loss due to current passing through the panel while the positive lead/negative enclosure combination virtually eliminates tank wall heating due to parallel currents.

DESCRIPTION OF THE PREFERRED EMBODIMENT

Figure 5:
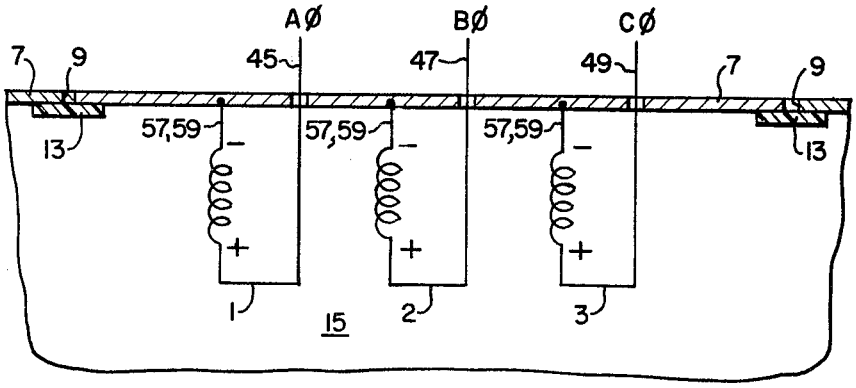
FIG. 5 is a schematic view showing a neutral connection for the three phase embodiment.

In FIG. 5 a transformer tank generally indicated at 7 comprises an opening 9 which is covered by a closure or panel 11. The panel 11 is comprised of an electrically conductive material such as metal. Dielectric means, such as a plate 13, secures the panel 11 in place within the opening 9 of the transformer tank 7. A transformer structure generally indicated at 15 is contained within the tank 7.

The problem of passing very high currents through the tank panel 11 is solved by using the panel as a neutral connection point. The net current through the panel 11 is zero inside the surface and unity at the outside surface with a transition zone therebetween. Thus the eddy loss in the tank panel 11 is less than would occur at unity current passing through the panel.

Figure 2:
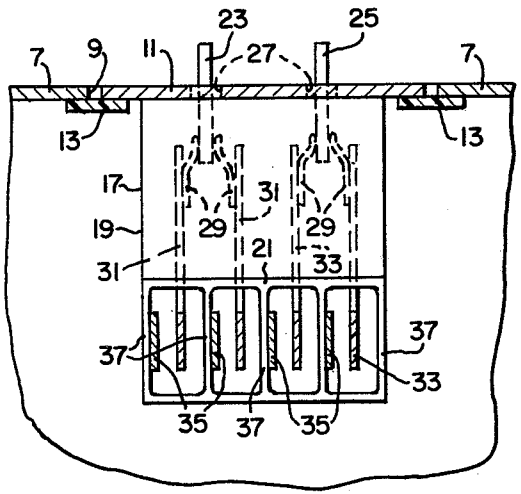
FIG. 2 is a sectional view taken along the lie II—II of FIG. 1.
Figure 1:
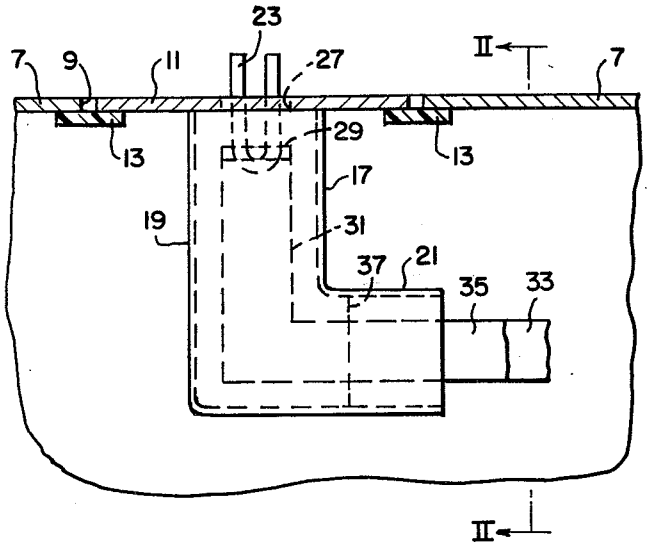
FIG. 1 is a fragmentary sectional view of a single phase enclosure in accordance with this invention.

For that purpose a tubular structure or boot 17 (FIG. 1) is mounted on the inside surface of the panel 11 and extends inwardly therefrom into the interior of the transformer. The structure 17 is comprised of an electrically conductive material and includes longitudinal and transverse portions 19, 21. For a single phase operation a pair of conductor means or conductors 23, 25 (FIG. 2) extend through apertures 27 in the panel 11. The inner end of the conductors are bifurcated at 29 to divide the conductors into similar parallel conductors 31, 33 which extend to a coil-core assembly of conventional structure within the tank 7. The conductors 31, 33 comprise the forward or positive paths of the circuit.

In accordance with this invention, return or negative conductors 35 are electrically connected to vertical cross vanes 37 of the transverse portion 21 and are disposed alternately between the forward or positive conductors 31, 33. Electrical connection or shorting of the negative polarity winding leads is made through the tubular structure 17 on the inside surface of the panel 11 where the tubular structure 17 is electrically connected to the panel.

Figure 3:
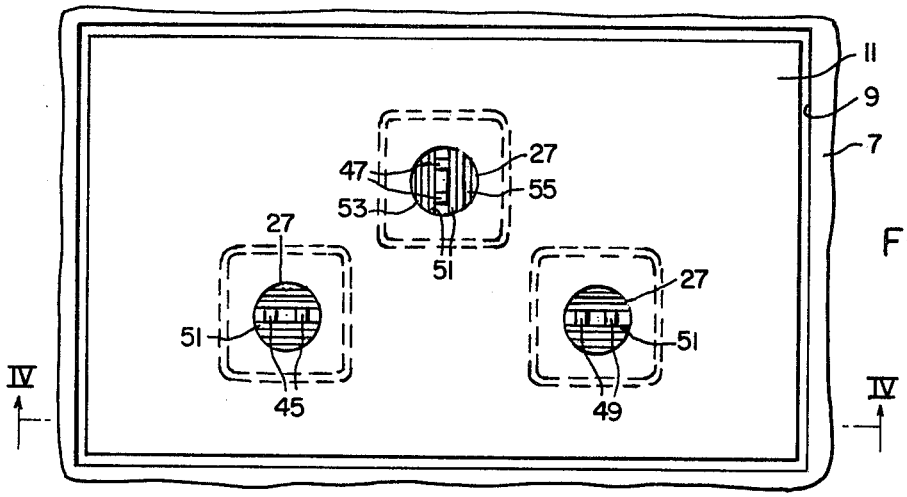
FIG. 3 is a fragmentary plan view of a conducting panel for a three phase neutral connection.
Figure 4:
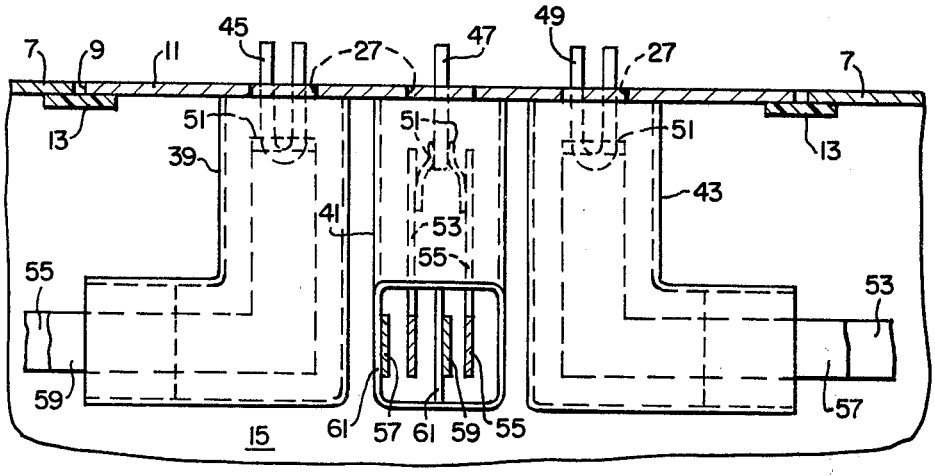
FIG. 4 is a sectional view taken on the line IV—IV of FIG. 1.

Another embodiment of the invention is disclosed in FIGS. 3 and 4 in which similar numerals refer to similar parts. This embodiment discloses a shorting cover three phase neutral connection which comprises three tubular structures or boots 39, 41, 43 which are substantially similar in construction to the structure 19. The conductor means for conductors 45, 47, 49 extend through the apertures 27. In a manner similar to the conductors 23, 25 (FIG. 2) the conductors 45, 47, 49 are bifurcated at 51 (as shown for conductor 47) and divided into a pair of L-shaped conductors 53, 55 which extend to the coils of the coil-core assembly 15. The assembly of the conductors 47, 53, 55 comprise the forward or positive paths of the winding leads. The negative or return paths include a pair of conductors 57, 59 which are electrically connected to cross vanes 61 of the tubular structures 39, 41, 43, whereby the net current through the panel 11 opening is 0 at the inside surface and unity at the outside surface with a transition zone therebetween. The manner in which the several conductors are connected are shown schematically in FIG. 5.

The problem of tank eddy heating due to very large currents flowing parallel to the tank panel as in prior structures, is solved by enclosing the conductors with the opposite polarity conductors. Thus, there is no magnetic field outside the enclosure to cause heating problems or to induce unbalanced voltage drops among the three phases. The three enclosures 39, 41, 43 are shorted together at the connecting tank panel 11 to form an ungrounded wye neutral connection (FIG. 5) and the conducting panel 11 is insulated from the tank wall 7.

Accordingly, positive polarity three phase winding leads are routed through the center of a negative polarity enclosure and passed through a conducting panel. The negative polarity winding leads are connected to the enclosures and shorted through the tank panel. The tank panel shorting method reduces eddy loss due to current passing through the panel, while the positive lead/negative enclosure combination virtually eliminates tank wall heating due to parallel currents.

What is claimed is:

1. An electric transformer comprising:

a transformer structure having a coil-core assembly, a tank casing enclosing the assembly and having an opening therein, a conducting panel for closing the opening, dielectric means between the panel and casing for holding the panel in place, the panel having an aperture, a conductive tubular structure mounted on and extending inwardly from the inside surface of the panel, the structure surrounding the aperture, conductor means extending from the coil-core assembly and through the tubular structure and aperture and including first and second conductors of opposite polarities, the first conductor being connected to the tubular structure, the second conductor extending through the tubular structure and the aperture, whereby a current passing through the panel reduces eddy current loss and heating of the tank casing associated therewith.

2. The transformer of claim 1 in which the panel is mounted within the opening and electrically insulated from the tank casing by the dielectric means.

3. The transformer of claim 2 in which the coil-core assembly comprises a three-phase transformer, and the conductor means comprising three-phase winding leads of forward and return paths.

4. The transformer of claim 3 in which the return path leads are connected to their corresponding tubular structures and the forward paths extending through the tubular structure and aperture.

* * * * *